US010208956B2

(12) United States Patent
Prociw et al.

(10) Patent No.: US 10,208,956 B2
(45) Date of Patent: Feb. 19, 2019

(54) COMBUSTOR FOR GAS TURBINE ENGINE

(71) Applicant: PRATT & WHITNEY CANADA CORP., Longueuil (CA)

(72) Inventors: Lev Alexander Prociw, Johnston, IA (US); Parham Zabeti, Toronto (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 134 days.

(21) Appl. No.: 14/969,998

(22) Filed: Dec. 15, 2015

(65) Prior Publication Data

US 2016/0097535 A1 Apr. 7, 2016

Related U.S. Application Data

(63) Continuation of application No. 13/795,089, filed on Mar. 12, 2013, now Pat. No. 9,228,747.

(51) Int. Cl.

| | |
|---|---|
| ***F23R 3/06*** | (2006.01) |
| ***F23R 3/28*** | (2006.01) |
| ***F23R 3/50*** | (2006.01) |

(52) U.S. Cl.

CPC ..... *F23R 3/06* (2013.01); *F23R 3/28* (2013.01); *F23R 3/283* (2013.01); *F23R 3/286* (2013.01); *F23R 3/50* (2013.01)

(58) Field of Classification Search

CPC .... F23R 3/06; F23R 3/28; F23R 3/283; F23R 3/50; F23R 3/286

USPC ..... 60/804, 752

See application file for complete search history.

(56) References Cited

U.S. PATENT DOCUMENTS

| | | | | |
|---|---|---|---|---|
| 2,718,757 A | | 9/1955 | Bloomer | |
| 3,905,192 A | * | 9/1975 | Pierce | F23R 3/26 60/748 |
| 4,292,801 A | | 10/1981 | Wilkes et al. | |
| 4,301,657 A | * | 11/1981 | Penny | F23R 3/12 60/748 |
| 4,984,429 A | | 1/1991 | Waslo | |

(Continued)

FOREIGN PATENT DOCUMENTS

| | | |
|---|---|---|
| EP | 1705426 A1 | 9/2006 |
| FR | 1165074 A | 10/1958 |
| GB | 686425 | 9/1950 |

*Primary Examiner* — Ted Kim

(74) *Attorney, Agent, or Firm* — Norton Rose Fulbright Canada LLP

(57) ABSTRACT

A combustor comprises an annular combustor chamber formed between the inner and outer liners, the annular combustor chamber having a central axis. Fuel nozzles are in fluid communication with the annular combustor chamber to inject fuel in the annular combustor chamber. The fuel nozzles are oriented to inject fuel in a fuel flow direction having an axial component relative to the central axis of the annular combustor chamber. Nozzle air inlets are in fluid communication with the annular combustor chamber to inject nozzle air generally radially in the annular combustor chamber. A plurality of dilution air holes are defined through the inner and outer liner downstream of the nozzle air inlets, the dilution holes configured for high pressure air to be injected from an exterior of the liners through the dilution air holes generally radially into the combustor chamber, a central axis of the dilution air holes having a tangential component relative to the central axis of the annular combustor chamber.

14 Claims, 4 Drawing Sheets

(56) References Cited

U.S. PATENT DOCUMENTS 5,025,622 A * 6/1991 Melconian ..... F23R 3/425 60/39.464
5,109,671 A * 5/1992 Haasis ..... F23R 3/06 60/757
5,127,229 A 7/1992 Ishibashi et al.
5,237,813 A * 8/1993 Harris ..... F23R 3/54 60/752
5,475,979 A 12/1995 Oag et al.
5,579,645 A * 12/1996 Prociw ..... F23R 3/54 60/748
5,816,050 A * 10/1998 Sjunnesson ..... F23R 3/14 60/732
5,934,067 A * 8/1999 Ansart ..... F23R 3/04 60/748
5,937,653 A * 8/1999 Alary ..... F23R 3/10 60/737
6,209,325 B1 4/2001 Alkabie
6,508,061 B2 * 1/2003 Stuttaford ..... F23R 3/34 60/737
6,810,673 B2 * 11/2004 Snyder ..... F23R 3/002 60/732
6,931,862 B2 * 8/2005 Harris ..... F23R 3/045 60/732
6,955,053 B1 * 10/2005 Chen ..... F23R 3/06 60/752
7,748,221 B2 7/2010 Patel et al.
7,942,006 B2 5/2011 Critchley et al.
8,051,664 B2 * 11/2011 Fish ..... F02C 7/222 60/739
8,091,367 B2 1/2012 Alkabie
2005/0076650 A1 4/2005 Dudebout et al.
2007/0028620 A1 2/2007 McMasters et al.
2007/0227149 A1 * 10/2007 Biebel ..... F23R 3/06 60/752
2007/0227150 A1 * 10/2007 Alkabie ..... F23R 3/54 60/754
2007/0271926 A1 11/2007 Alkabie
2010/0212325 A1 8/2010 Condevaux et al.
2010/0281881 A1 * 11/2010 Morenko ..... F02C 3/14 60/796
2012/0240588 A1 9/2012 Patel et al.
2014/0190178 A1 7/2014 O'Donnell
2014/0238024 A1 * 8/2014 Kraemer ..... F23R 3/14 60/733

* cited by examiner

COMBUSTOR FOR GAS TURBINE ENGINE

CROSS-REFERENCE TO RELATED APPLICATION

The present application is a continuation application of U.S. patent application Ser. No. 13/795,089 filed on Mar. 12, 2013, incorporated herewith by reference.

FIELD OF THE INVENTION

The present application relates to gas turbine engines and to a combustor thereof.

BACKGROUND OF THE ART

In combustors of gas turbine engines, an efficient use of primary zone volume in annular combustor is desired. An important component in improving the mixing within the primary zone of the combustor is creating high swirl, while minimizing the amount of components. Furthermore, typical combustion systems deploy a relatively low number of discrete fuel nozzles which individually mix air and fuel as the fuel/air mixture is introduced into the combustion zone. Improvement is desirable.

SUMMARY

In accordance with an embodiment of the present disclosure, there is provided a combustor comprising: an inner liner; an outer liner spaced apart from the inner liner; an annular combustor chamber formed between the inner and outer liners, the annular combustor chamber having a central axis; fuel nozzles in fluid communication with the annular combustor chamber to inject fuel in the annular combustor chamber, the fuel nozzles oriented to inject fuel in a fuel flow direction having an axial component relative to the central axis of the annular combustor chamber; nozzle air inlets in fluid communication with the annular combustor chamber to inject nozzle air generally radially in the annular combustor chamber; and a plurality of dilution air holes defined through the inner and outer liner downstream of the nozzle air inlets, the dilution holes configured for high pressure air to be injected from an exterior of the liners through the dilution air holes generally radially into the combustor chamber, a central axis of the dilution air holes having a tangential component relative to the central axis of the annular combustor chamber.

In accordance with another embodiment of the present disclosure, there is provided a gas turbine engine comprising a combustor, the combustor comprising: an inner liner; an outer liner spaced apart from the inner liner; an annular combustor chamber formed between the inner and outer liners, the annular combustor chamber having a central axis; fuel nozzles in fluid communication with the annular combustor chamber to inject fuel in the annular combustor chamber, the fuel nozzles oriented to inject fuel in a fuel flow direction having an axial component relative to the central axis of the annular combustor chamber; nozzle air inlets in fluid communication with the annular combustor chamber to inject nozzle air generally radially in the annular combustor chamber; and a plurality of dilution air holes defined through the inner and outer liner downstream of the nozzle air inlets, the dilution holes configured for high pressure air to be injected from an exterior of the liners through the dilution air holes generally radially into the combustor chamber, a central axis of the dilution air holes having a tangential component relative to the central axis of the annular combustor chamber.

In accordance with yet another embodiment of the present disclosure, there is provided a method for mixing fuel and nozzle air in an annular combustor chamber, comprising: injecting fuel in a fuel direction having at least an axial component relative to a central axis of the annular combustor chamber; injecting high pressure nozzle air from an exterior of the annular combustor chamber through holes made in an inner liner and an outer liner of the annular combustor chamber into a fuel flow; injecting high pressure dilution air from an exterior of the annular combustor chamber through holes made in the outer liner of the annular combustor chamber into a fuel flow, the holes being oriented such that dilution air has a tangential component relative to a central axis of the annular combustor chamber; and injecting high pressure dilution air from an exterior of the annular combustor chamber through holes made in an inner liner of the annular combustor chamber into a fuel flow, the holes being oriented such that dilution air has a tangential component relative to a central axis of the annular combustor chamber, the tangential components of the dilution air of the inner liner and outer liner being in a same direction.

DESCRIPTION OF THE EMBODIMENT

Figure 1:
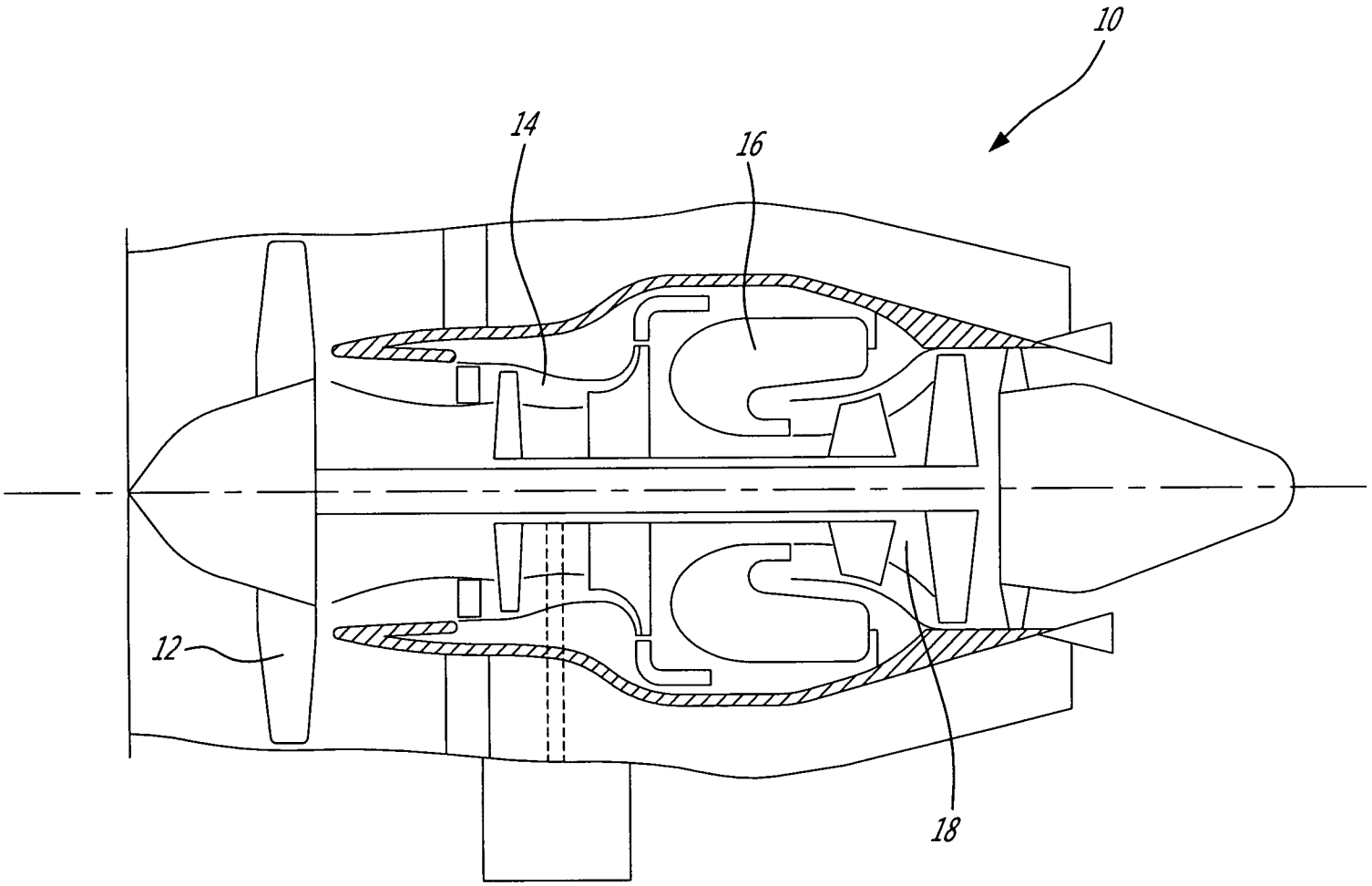
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air within a compressor case 15, a combustor 16 in which the compressed air is mixed with fuel and ignited for generating an annular stream of hot combustion gases, and a turbine section 18 for extracting energy from the combustion gases.

Figure 2:
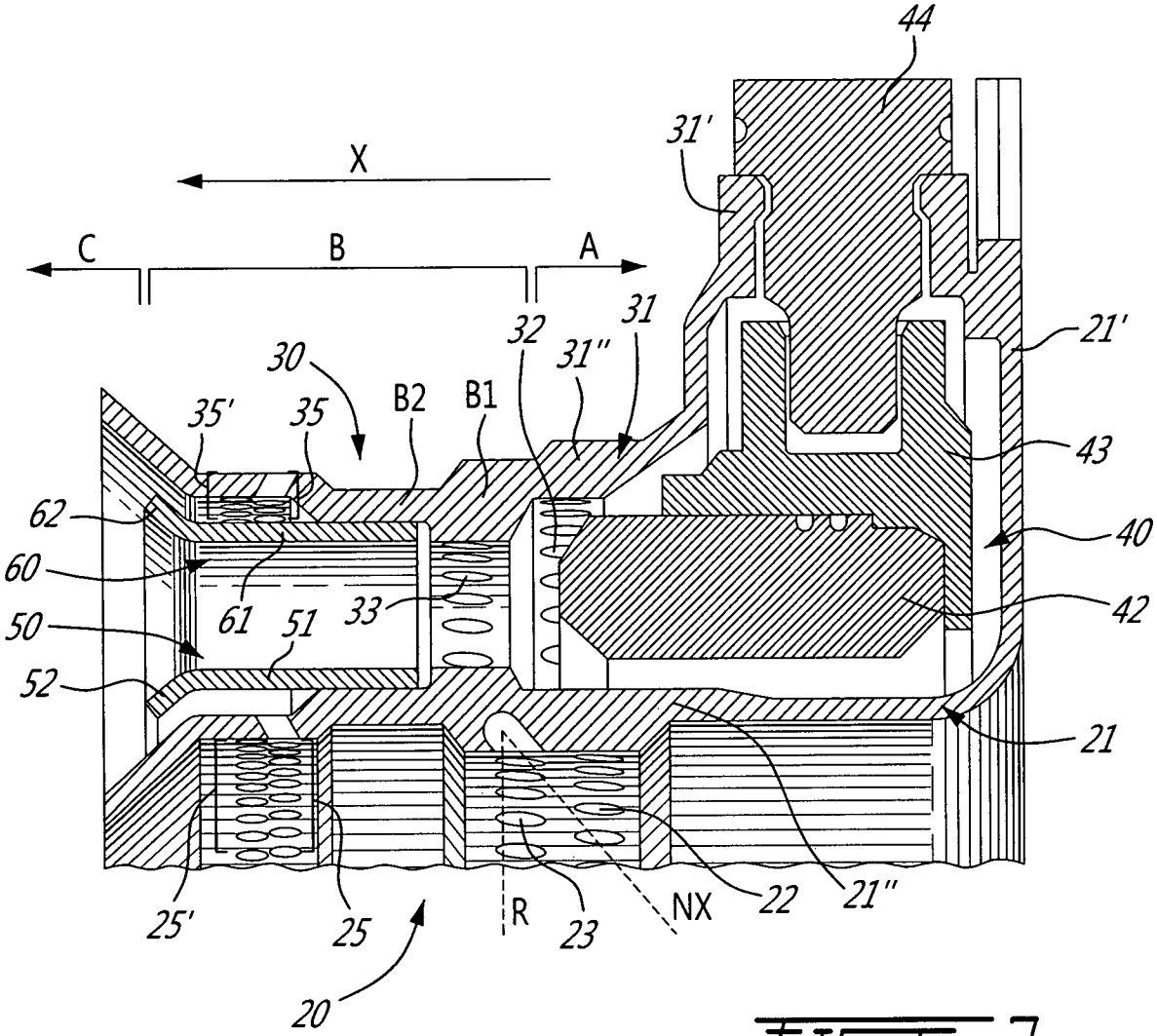
FIG. 2 is a longitudinal sectional view of a combustor assembly in accordance with the present disclosure.
Figure 3:
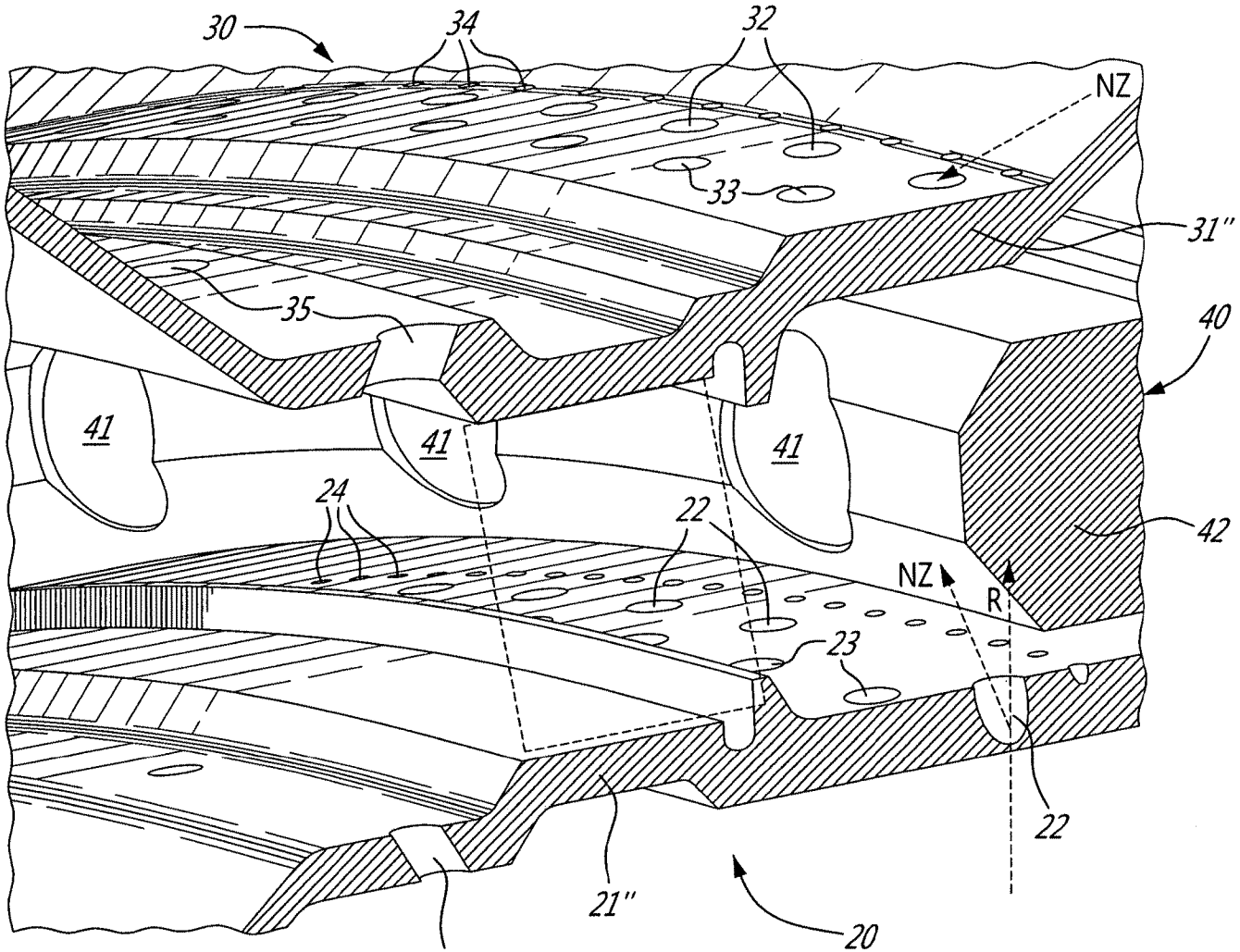
FIG. 3 is a sectional perspective view of the combustor assembly of FIG. 2.

The combustor 16 is illustrated in FIG. 1 as being of the reverse-flow type, however the skilled reader will appreciate that the description herein may be applied to many combustor types, such as straight-flow combustors, radial combustors, lean combustors, and other suitable annular combustor configurations. The combustor 16 has an annual geometry with an inner liner 20 and an outer liner 30 defining therebetween an annular combustor chamber in which fuel and air mix and combustion occurs. As shown in FIGS. 2 and 3, a fuel manifold 40 is positioned inside the combustion chamber and therefore between the inner liner 20 and the outer liner 30.

In the illustrated embodiment, an upstream end of the combustor 16 has a sequence of zones, namely zones A, B, and C. The manifold 40 is in upstream zone A. A narrowing portion B1 is defined in mixing zone B. A shoulder B2 is defined in mixing zone B to support components involved in the mixing of the fuel and air, such as a louver, as described hereinafter. In dilution zone C, the combustor 16 flares to allow wall cooling and dilution air to mix with the fuel and nozzle air mixture coming from the zones B and C of the combustor 16. A combustion zone is downstream of the dilution zone C.

The inner liner 20 and the outer liner 30 respectively have support walls 21 and 31 by which the manifold 40 is supported to be held in position inside the combustor 16. Hence, the support walls 21 and 31 may have outward radial wall portions 21' and 31', respectively, supporting components of the manifold 40, and turning into respective axial wall portions 21" and 31" towards zone B. Nozzle air inlets 22 and 32 are circumferentially distributed in the inner liner 20 and outer liner 30, respectively. According to an embodiment, the nozzle air inlets 22 and nozzle air inlets 32 are equidistantly distributed. The nozzle air inlets 22 and nozzle air inlets 32 are opposite one another across combustor chamber. It is observed that the central axis of one or more of the nozzle air inlets 22 and 32, generally shown as N, may have an axial component and/or a tangential component, as opposed to being strictly radial. Referring to FIG. 2, it is observed that the central axis N is oblique relative to a radial axis R of the combustor 16, in a plane in which lies a longitudinal axis X of the combustor 16. Hence, the axial component NX of the central axis N is oriented downstream, i.e., in the same direction as that of the flow of the fuel and air, whereby the central axis N leans towards a direction of flow (for instance generally parallel to the longitudinal axis X). In an embodiment, the central axis N could lean against a direction of the flow.

Figure 4:
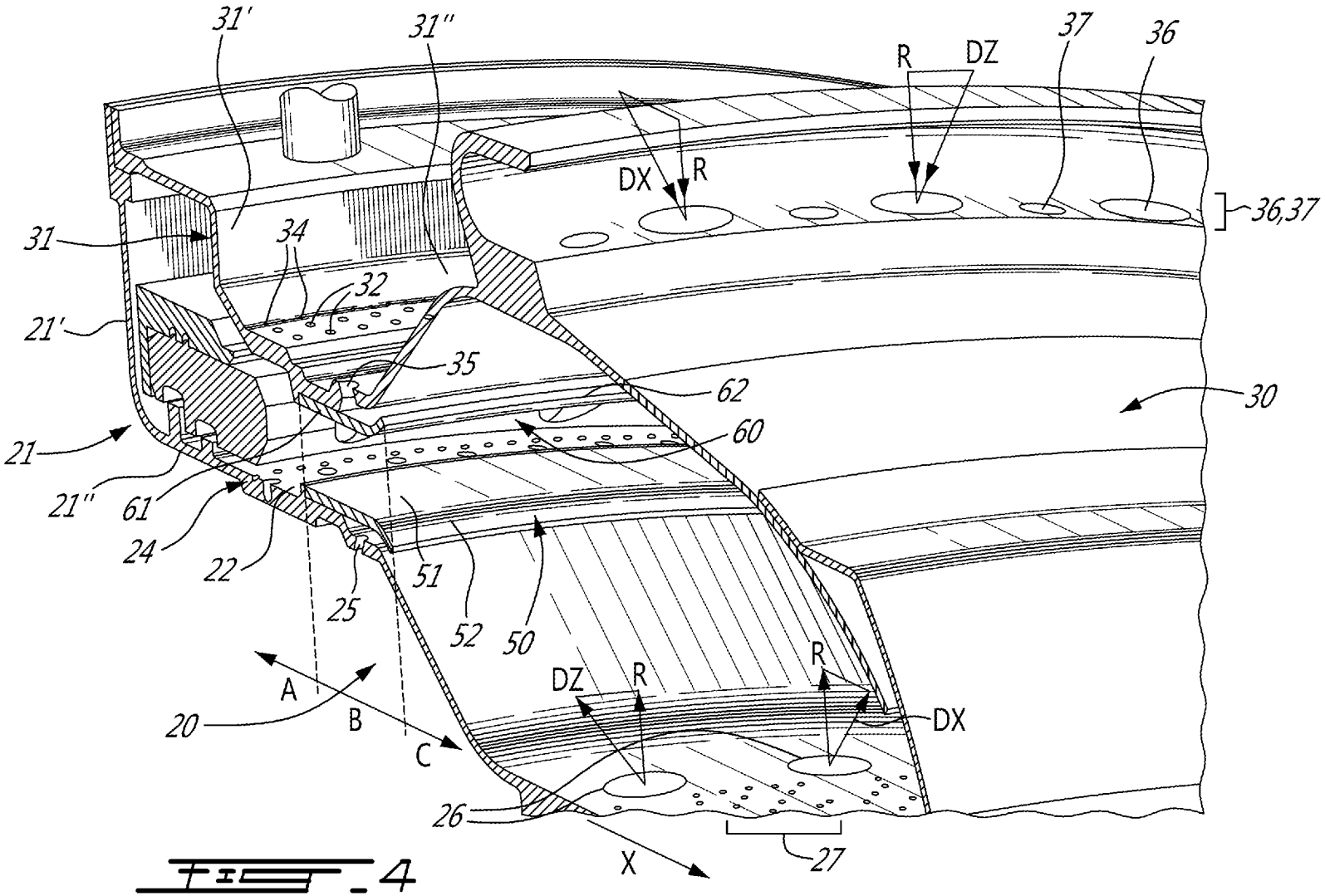
FIG. 4 is another sectional perspective view of the combustor assembly of FIG. 2.

Referring to FIGS. 3 and 4, the central axis N of one or more of the nozzle air inlets 22 and 32 may have a tangential component NZ, in addition or in alternative to the axial component NX. For simplicity, in FIGS. 3 and 4, only the tangential component NZ of the central axis N is shown, although the nozzle air inlets 22 and 32 may have both an axial and a tangential component. The tangential component NZ is oblique relative to radial axis R in an axial plane, i.e., the axial plane being defined as having the longitudinal axis X of the combustor 16 being normal to the axial plane. In FIG. 3, the tangential component NZ is in a counterclockwise direction, while in FIG. 4, the tangential component NZ is clockwise. The tangential component NZ may allow an increase residence time of the air and fuel mixture in the downstream mixing zone B of the combustor 16.

Referring to FIG. 2, nozzle air inlets 23 and 33 may be located in the narrowing portion B1 of mixing zone B. Alternatively, as shown in FIG. 3, the nozzle air inlets 23 and 33 may be in the upstream zone A. The nozzle air inlets 23 and 33 may form a second circumferential distribution of inlets, if the combustor 16 has two circumferential distributions of inlets (unlike FIG. 4, showing a single circumferential distribution). In similar fashion to the set of inlets 22/32, the inlets 23 and 33 are respectively in the inner liner 20 and outer liner 30. The inlets 23 and 33 may be oriented such that their central axes X may have an axial component and/or a tangential component.

Hence, the combustor 16 comprises numerous nozzle air inlets (e.g., 22, 23, 32, 33) impinging onto the fuel sprays produced by the fuel manifold 40, in close proximity to the fuel nozzles, thereby encouraging rapid mixing of air and fuel. The orientation of the nozzle air inlets relative to the fuel nozzles (not shown) may create the necessary shearing forces between air jets and fuel stream, to encourage secondary fuel droplets breakup, and assist in rapid fuel mixing and vaporization.

Purged air inlets 24 and 34 may be respectively defined in the inner liner 20 and the outer liner 30, and be positioned in the upstream zone A of the combustor 16. In similar fashion to the sets of nozzle air inlets 22/32, a central axis of the purged air inlets 24 and 34 may lean toward a direction of flow with an axial component similar to axial component NX, as shown in FIG. 2. Purged air inlets 24 and 34 produce a flow of air on the downstream surface of the manifold 40. As shown in FIGS. 2, 3 and 4, sets of cooling air inlets 25 and 35, and cooling air inlets 25' and 35', respectively in the inner liner 20 and the outer liner 30, may be circumferentially distributed in the mixing zone B downstream of the sets of nozzle air inlets 23 and 33. The cooling air inlets 25, 25', 35, 35' may be in channels defined by the liners 20 and 30 and mixing walls 50 and 60 (described hereinafter). Cooling air inlets 25, 25', 35 and 35' may produce a flow of air on flaring wall portions of the inner liner 20 and outer liner 30.

Referring to FIG. 4, dilution air inlets 26 and 36 are circumferentially distributed in the dilution zone C of the combustor 16, respectively in the inner liner 20 and outer liner 30. According to an embodiment, the dilution air inlets 26 and 36 are equidistantly distributed, and opposite one another across combustor chamber. It is observed that the central axis of one or more of the dilution air inlets 26 and 36, generally shown as D, may have an axial component and/or a tangential component, as opposed to being strictly radial. Referring to FIG. 4, the central axis D is oblique relative to a radial axis R of the combustor 16, in a plane in which lies a longitudinal axis X of the combustor 16. Hence, the axial component DX of the central axis D is oriented downstream, i.e., in the same direction as that of the flow of the fuel and air, whereby the central axis D leans towards a direction of flow (for instance generally parallel to the longitudinal axis X). In an embodiment, the central axis D could lean against a direction of the flow.

Still referring to FIG. 4, the central axis D of one or more of the dilution air inlets 26 and 36 may have a tangential component DZ, in addition or in alternative to the axial component DX. For simplicity, in FIG. 4, one inlet is shown with only the axial component DX, while another is shown with only the tangential component DZ. It should however be understood that the inlets 26 and 36 may have both the axial component DX and the tangential component DZ. The tangential component DZ is oblique relative to radial axis R in an axial plane, i.e., the axial plane being defined as having the longitudinal axis X of the combustor 16 being normal to the axial plane. In FIG. 4, the tangential component DZ is in a counterclockwise direction. It is thus observed that the tangential component DZ of the central axes D may be in an opposite direction than that of the tangential component NZ of the central axes N of the nozzle air inlets 22, 23, 32, and/or 33, shown as being clockwise. The opposite direction of tangential components DZ and NZ may enhance fluid mixing to render the fuel and air mixture more uniform, which may lead to keeping the flame temperature relatively low (and related effects, such as lower NOx and smoke emissions, low pattern factor, and enhanced hot-section durability). The opposite tangential direction of dilution air holes relative to the nozzle air holes cause the creation of a recirculation volume immediately upstream of the penetrating dilution jets, further enhancing fuel-air mixing before burning, in a relatively small combustor volume. It is nonetheless possible to have the tangential components of nozzle air inlets and dilution air inlets being in the same direction, or without tangential components.

Referring to FIG. 4, a plurality of cooling air inlets 27 may be defined in the inner liner 20 and outer liner 30 (although not shown). The outer liner 30 has a set of dilution air inlets 37 in an alternating sequence with the set of dilution air inlets 36. The dilution air inlets 37 have a smaller diameter than that of the dilution air inlets 36. This alternating sequence is a configuration considered to maximize the volume of dilution in a single circumferential band, while providing suitable structural integrity to the outer liner 30.

Referring to FIGS. 2 to 4, the manifold 40 is schematically shown as having fuel injector sites 41 facing downstream on an annular support 42. The annular support 42 may be in the form of a full ring, or a segmented ring. The fuel injector sites 41 are circumferentially distributed in the annular support 42, and each accommodate a fuel nozzle (not shown). It is considered to use flat spray nozzles to reduce the number of fuel injector sites 41 yet have a similar spray coverage angle. As shown in FIGS. 3 and 4, the number of nozzle air inlets (e.g., 22, 23, 32, and 33) is substantially greater than the number of fuel injector sites 41, and thus of fuel nozzles of the manifold 40. Moreover, the continuous circumferential distribution of the nozzle air inlets relative to the discrete fuel nozzles creates a relative uniform air flow throughout the upstream zone A in which the fuel stream is injected.

A liner interface comprising a ring 43 and locating pins 44 or the like support means may be used as an interface between the support walls 21 and 31 of the inner liner 20 and outer liner 30, respectively, and the annular support 42 of the manifold 40. Hence, as the manifold 40 is connected to the combustor 16 and is inside the combustor 16, there is no relative axial displacement between the combustor 16 and the manifold 40.

As opposed to manifolds located outside of the gas generator case, and outside of the combustor, the arrangement shown in FIGS. 2-4 of the manifold 40 located inside the combustor 16 does not require a gas shielding envelope, as the liners 20 and 30 act as heat shields. The manifold 40 is substantially concealed from the hot air circulating outside the combustor 16, as the connection of the manifold 40 with an exterior of the combustor 16 may be limited to a fuel supply connector projecting out of the combustor 16. Moreover, in case of manifold leakage, the fuel/flame is contained inside the combustor 16, as opposed to being in the gas generator case. Also, the positioning of the manifold 40 inside the combustor 16 may result in the absence of a combustor dome, and hence of cooling schemes or heat shields.

Referring to FIGS. 2 and 4, mixing walls 50 and 60 are respectively located in the inner liner 20 and outer liner 30, against the shoulders B2 downstream of the narrowing portion B1 of the mixing zone B, to define a straight mixing channel. The mixing walls 50 and 60 form a louver. Hence, the mixing walls 50 and 60 concurrently define a mixing channel of annular geometry in which the fuel and nozzle air will mix. The mixing walls 50 and 60 are straight wall sections 51 and 61 respectively, which straight wall sections 51 and 61 are parallel to one another in a longitudinal plane of the combustor 16 (i.e., a plane of the page showing FIG. 2). The straight wall sections 51 and 61 may also be parallel to the longitudinal axis X of the combustor 16. Other geometries are considered, such as quasi-straight walls, a diverging or converging relation between wall sections 51 and 61, among other possibilities. For instance, a diverging relation between wall sections 51 and 61 may increase the tangential velocity of the fluid flow. It is observed that the length of the straight wall sections 51 and 61 (along longitudinal axis X in the illustrated embodiment) is several times greater than the height of the channel formed thereby, i.e., spacing between the straight wall sections 51 and 61 in a radial direction in the illustrated embodiment. Moreover, the height of the channel is substantially smaller than a height of the combustion zone downstream of the dilution zone C. According to an embodiment, the ratio of length to height is between 2:1 and 4:1, inclusively, although the ratio may be outside of this range in some configurations. The presence of narrowing portion B1 upstream of the mixing channel may cause a relatively high flow velocity inside the mixing channel. This may for instance reduce the flashback in case of auto-ignition during starting and transient flow conditions. The configuration of the mixing zone B is suited for high air flow pressure drop, high air mass flow rate and introduction of high tangential momentum, which may contribute to reaching a high air flow velocity.

The mixing walls 50 and 60 respectively have lips 52 and 62 by which the mixing annular chamber flares into dilution zone C of the combustor 16. Moreover, the lips 52 and 62 may direct a flow of cooling air from the cooling air inlets 25, 25', 35, 35' along the flaring wall portions of the inner liner 20 and outer liner 30 in dilution zone C.

Hence, the method of mixing fuel and nozzle air is performed by injecting fuel in a fuel direction having axial and/or tangential components, relative to the central axis X of the combustor 16. Simultaneously, nozzle air is injected from an exterior of the combustor 16 through the holes 32, 33 made in the outer liner 30 into a fuel flow. The holes 32, 33 are oriented such that nozzle air has at least a tangential component NZ relative to the central axis X of the combustor 16. Nozzle air is injected from an exterior of the combustor 16 through holes 22, 23 made in the inner liner 20 into the fuel flow. The holes 22, 23 are oriented such that nozzle air has at least the tangential component NZ relative to the central axis X, with the tangential components NZ of the nozzle air of the inner liner 20 and outer liner 30 being in a same direction. Dilution air may be injected with a tangential component DZ in an opposite direction.

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

The invention claimed is:

1. A combustor comprising:

an inner liner;

an outer liner spaced apart from the inner liner;

an annular combustor chamber formed between the inner and outer liners, the annular combustor chamber having a central axis;

fuel nozzles in fluid communication with the annular combustor chamber to inject fuel in the annular combustor chamber, the fuel nozzles oriented axially to inject fuel in a fuel flow direction having an axial component relative to the central axis of the annular combustor chamber;

nozzle air inlets in fluid communication with the annular combustor chamber to inject nozzle air in the annular combustor chamber, the nozzle air inlets configured for high pressure air to be injected from an exterior of the liners through the nozzle air inlets into the annular combustor chamber and impinge on the injected fuel so as to encourage mixing of injected fuel and injected air, a central axis of each of a plurality of the nozzle air inlets having a tangential component and an axial component relative to the central axis of the annular combustion chamber, the tangential component of the central axes of the nozzle air inlets being oriented in a same common direction;

a plurality of dilution air holes defined through the inner and outer liner downstream of the nozzle air inlets, the dilution holes configured for high pressure air to be injected from an exterior of the liners through the dilution air holes into the combustor chamber, a central axis of each of a plurality of the dilution air holes having a tangential component relative to the annular combustor chamber, the tangential component of the central axes of the dilution air holes being oriented in a same common direction opposite to that of the tangential component of the nozzle air inlets; and a plurality of cooling air inlets defined through the inner and outer liner at least downstream of the dilution air holes, the cooling air inlets being substantially smaller than the dilution air holes.

2. The combustor according to claim 1, further comprising a mixing zone of reduced radial height between the nozzle air inlets and the dilution air holes.

3. The combustor according to claim 2, wherein the inner and outer liners concurrently defining a flaring zone in the annular combustion chamber, the dilution air holes being downstream of the flaring zone, and the nozzle air inlets and the mixing zone being upstream of the flaring zone.

4. The combustor according to claim 1, wherein the central axis of said dilution air holes has an axial component relative to the central axis of the annular combustor chamber, the axial component being in a same direction as the axial component of the fuel flow.

5. The combustor according to claim 1, wherein the dilution air holes are circumferentially distributed in the inner liner and in the outer liner so as to be in sets opposite one another, to form a first circumferential band.

6. The combustor according to claim 5, wherein the dilution air holes in the outer liner are provided in a set of larger-dimension holes and in another set of smaller-dimension holes, the larger-dimension holes and smaller-dimension holes being circumferentially distributed in an alternating sequence.

7. The combustor according to claim 1, wherein the number of dilution air holes in the outer liner exceeds the number of dilution air holes in the inner liner.

8. The combustor according to claim 1, wherein the fuel nozzles are part of an annular fuel manifold, the fuel manifold being positioned inside the annular combustor chamber.

9. The combustor according to claim 1, wherein the dilution air holes are circumferentially distributed in the inner liner to form a circumferential band.

10. The combustor according to claim 9, wherein the dilution air holes are circumferentially distributed in the outer liner to form the circumferential band opposite the circumferential band in the inner liner.

11. The combustor according to claim 1, wherein the dilution air holes are circumferentially distributed in the outer liner to form a circumferential band.

12. The combustor according to claim 1, wherein the fuel nozzles are in fuel injection sites, with an axis of an opening of each of the fuel injection sites being substantially parallel to the central axis.

13. The combustor according to claim 1, wherein the fuel nozzles are located at a first position along the central axis, with the annular chamber extending toward a second position along the central axis, the plurality of dilution air holes all being located between the first position and the second position.

14. The combustor according to claim 1, wherein the fuel nozzles are not oriented toward the central axis.

* * * * *